United States Patent [19]

Morris et al.

[11] 4,099,708

[45] Jul. 11, 1978

[54] APPARATUS FOR APPLYING GRANULAR REFRACTORY MATERIAL TO SURFACES

[75] Inventors: John C. Morris, Birmingham; James K. Weidman, Gadsden; Michael D. Prior, Pell City, all of Ala.

[73] Assignee: Riverside Clay Company, Pell City, Ala.

[21] Appl. No.: 821,554

[22] Filed: Aug. 3, 1977

[51] Int. Cl.[2] ..... B05B 3/00

[52] U.S. Cl. ..... 266/281; 239/227

[58] Field of Search ..... 118/303, 317, 318, 323; 239/227, 433; 264/30; 266/281, 287

[56] References Cited

U.S. PATENT DOCUMENTS 3,797,745 3/1974 Haus ..... 239/227

*Primary Examiner*—Gerald A. Dost

*Attorney, Agent, or Firm*—Hugh P. Carter

[57] ABSTRACT

An improved apparatus for controlled application of granular refractory material to the linings of ladles, furnaces, and other open top vessels employed in the handling of molten metals. The apparatus comprises a generally vertically arranged pair of telescopically related conduits, there being a nozzle on the lower end of the innermost conduit. Granular material is supplied to the upper end of the innermost conduit and water is supplied through a member to the upper end of the outer conduit and from the lower end of the outer conduit to the nozzle. Means is provided for rotating the conduits and hence the nozzle. Other means is provided for raising and lowering the nozzle and the entire apparatus may be suspended from a crane or the like over the vessel whose lining is to be coated, repaired, filled, etc. The invention is characterized by the fact that the apparatus is capable of being so used that the operator may apply the material to any seleced area of the surface being treated, whereby cracks, holes, or other defective areas of the lining may be repaired as distinguished from having to apply the granular material to the entire surface in order to repair one area of the same.

6 Claims, 12 Drawing Figures

APPARATUS FOR APPLYING GRANULAR REFRACTORY MATERIAL TO SURFACES

Our invention relates to apparatus useful for prolonging the life of the linings of ladles, furnaces, and other open top vessels used in the handling of molten metals.

An object of our invention is to provide apparatus for controlled application of granular material to the existing refractory linings of ladles and the like, whether the ladles and their linings are hot or cold, thereby to repair cracks, breaks, wear spots and the like, thus to prolong such linings, and to install complete refractory linings.

Our invention relates particularly to apparatus of the character designated which may be suspended by a crane or the like over the vessel to be repaired, which apparatus has a nozzle at the lower end through which the granular material, mixed with a suitable amount of water, may be applied under pressure to the walls and bottom of the vessel lining, completely around the same, and which is fully under control of the operator with regard to the amount of the material being applied at a given spot.

More in detail, an object of our invention is to provide a granular material applicator for the refractory linings of vessels of the kind indicated in which the nozzle is not only rotatable 360°, but also in which the nozzle may be raised or lowered, at will, under control of the operator.

Further objects of our invention are to simplify and improve the manner of supplying the nozzle with the granular material and water; to provide apparatus which may be used to repair or install a complete refractory lining of a hot or cold ladle or the like; and in general, to provide an improved apparatus of the character designated which eliminates by and large, the inaccuracies and misapplication of the granular material when manually applied, namely, when applied by an operator holding a nozzle in his hand.

Apparatus illustrating features of our invention is shown in the accompanying drawings, forming a part of this application, in which.

Figure 1:
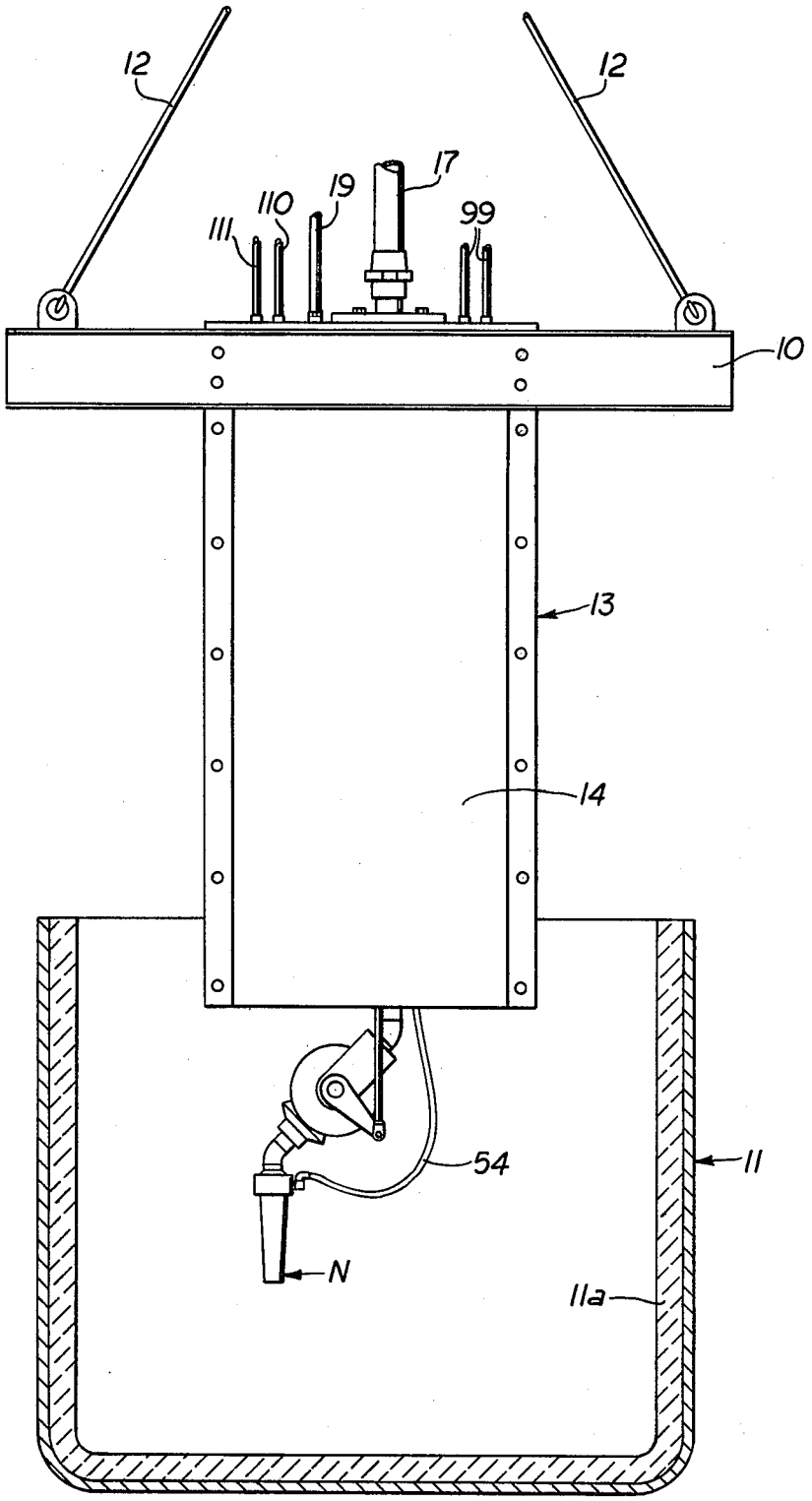
FIG. 1 is an elevational view showing our improved apparatus supported in place relative to an open mouth vessel such as a ladle, ready to apply the material to the vessel thereof, certain of the parts being broken away and in section.

Referring now to the drawings for a better understanding of our invention, our device comprises generally a cross frame member 10 which is adapted to be suspended in position over a ladle, furnace, or the like, indicated at 11, by means of cables 12 or the like. Cables 12 may be connected to an overhead crane of appropriate size and capacity.

Our apparatus comprises generally the body section indicated generally by the numeral 13 which may be enclosed with plates 14 as indicated. At the lower end of the section 13 we show a nozzle N to which the granular material in dry form is supplied through a supply conduit 17 and also to which water is supplied through a conduit 54, all as will be explained more in detail. Suffice it here to say that the dry material is supplied through the conduit 17 and water, supplied through a conduit 19, finally reaches the nozzle, as will be explained. It will be understood that the granular material is supplied in an airborne stream, under pressure, usually on the order of 55 to 60 pounds per square inch and that the water is likewise supplied under some pressure, for instance, up to 60 pounds per square inch. Therefore, as the description proceeds, it will be seen that the moistened granular material may be applied to all areas of the existing lining 11$^a$, thus to repair it or to coat it, thereby to prolong its life.

Spanning the cross members 10 forming the supporting framework is a plate member 21. It is from this plate member that we suspend the major portion of our improved apparatus as will presently appear.

Secured by means of rivets, bolts or the like 22 to the members 10 are depending channels 23. Spanning the space between the channels are horizontal plates 24 and 26, appropriately secured at their ends to the channel members 23. Also, at the lower ends of the members 23 we provide a third cross plate 27. The plate is provided with an opening 27$^a$ and the opening is fitted with a cylindrical member 27$^b$ of a diameter to pass the lower end of the mechanism. See FIG. 2.

The plate 21 is provided with an opening 28. Placed over the opening 28 is a plate 29. Secured by bolts 31 to the plate 29 is the upper section 32 of a connecting unit. The connecting unit also comprises a lower section 33.

Figures 3, 4:
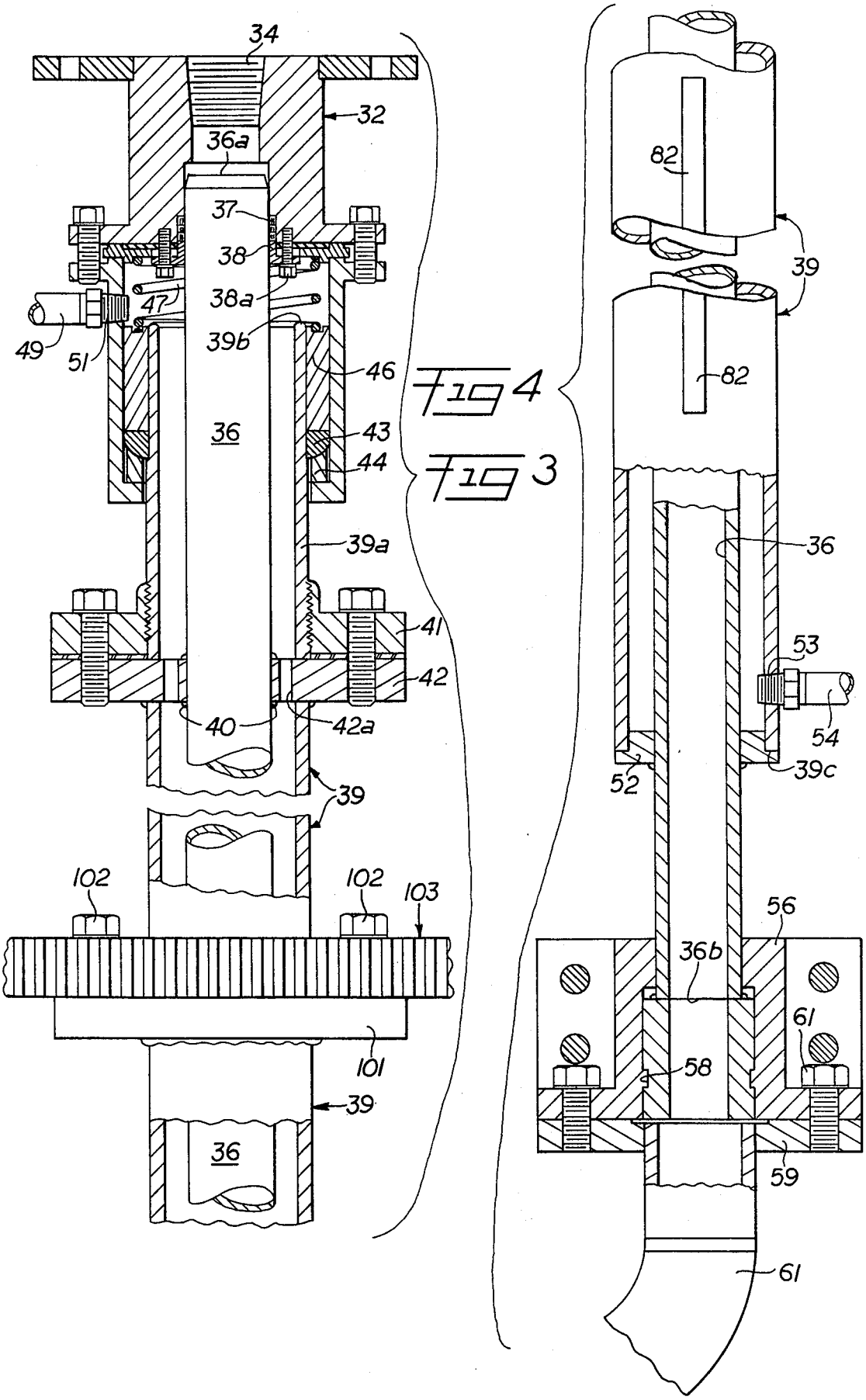
FIG. 3 is an enlarged partly sectioned view of the upper end of the conduits and associated mechanisms through which the granular material and water are supplied.
FIG. 4 is a view corresponding to FIG. 3 and showing the lower end of the conduits.
Figure 5:
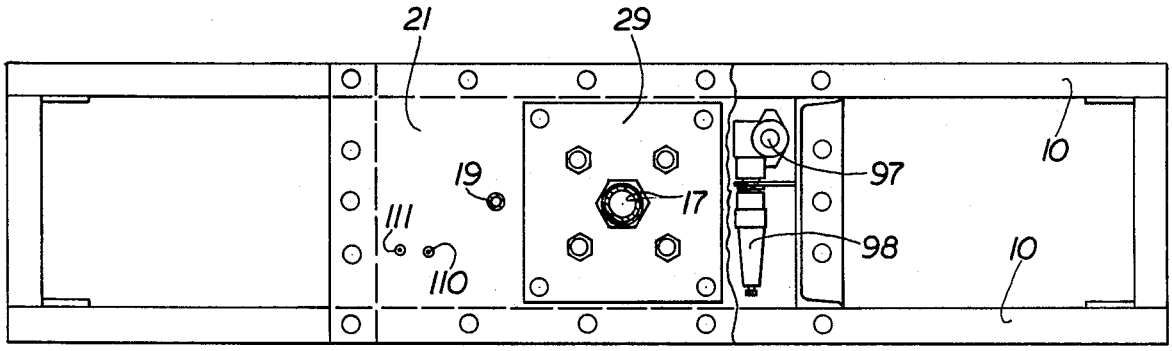
FIG. 5 is a plan view of the apparatus with certain parts broken away and in section.
Figure 6:
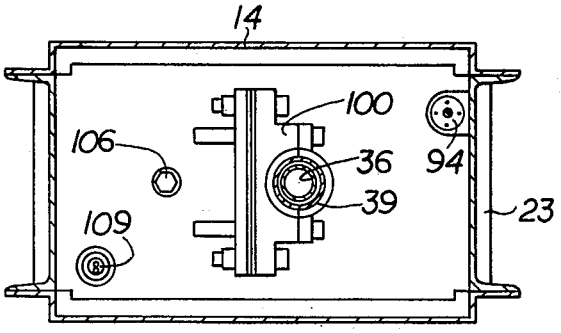
FIG. 6 is a detail sectional view taken generally along line 6—6 of FIG. 2.
Figure 7:
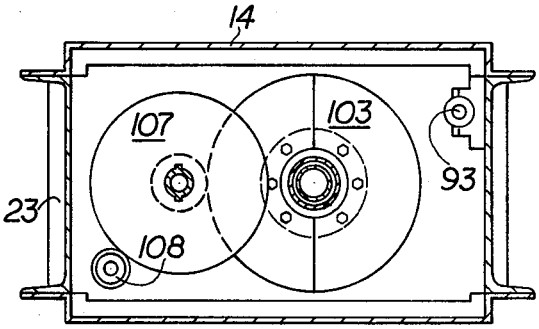
FIG. 7 is a detail sectional view taken generally along line 7—7 of FIG. 2.
Figure 8:
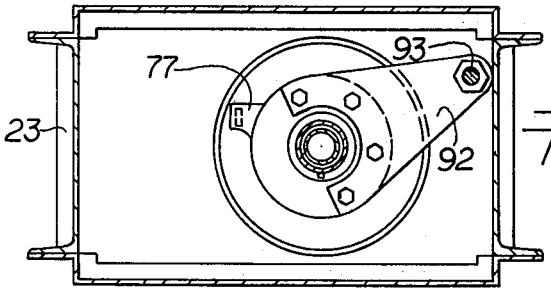
FIG. 8 is a detail sectional view taken generally along line 8—8 of FIG. 2.

Referring particularly to FIG. 3 it will be seen that the upper section 32 is threaded and tapped as at 34 to receive a nipple 35 to which the supply conduit for the granular material is attached.

At 36 we indicate an inner conduit member which extends from its upper member 36$^a$ to its lower end 36$^b$. The upper end of the member 36 is rotatably connected to the section 32 and made substantially fluid-tight relative thereto by means of packing 37, the gland of which is indicated at 38. Suitable bolts 38$^a$ serve to draw the gland tightly onto the packing as is understood. It will thus be seen that granular material in dry form when supplied to the nipple 35 is delivered all the way to the end 36$^b$ of the inner conduit 36, and thence to the nozzle as will appear.

Telescopically related to the inner conduit 36 is an outer conduit indicated generally by the numeral 39. The upper end of the conduit 39 may comprise a nipple section 39$^a$ threaded into a flange 41 which in turn is bolted to a flange 42 carried by the lower section of the outer conduit 39 as shown particularly in FIG. 3. The inner conduit is welded to the flange 42 as indicated at 40. The flange 42 is provided with a plurality of holes 42$^a$ to permit the flow of water through the conduit 39.

The upper end 39$^b$ of the nipple 39$^a$ is rotatably received in the lower section 33. Secured to the nipple 39$^b$ is an annular enlargement 43 which rests on a graphite packing ring 44 mounted in the section 33. An annular guide member 46 rests on top of the enlargement 44 and a spring 47 pushes the guide downwardly, thus to hold the entire outer conduit 39 and nipple 39$^a$ rotatably, but sealed, against the graphite ring 44. Water under pressure from the supply conduit 19 is admitted through a hose section 49 into the section 33 through a connection 51. See FIG. 3.

The outer conduit 39 at its lower end 39$^c$ is made watertight to the outside of the inner conduit 36 by a filler ring 52. Water in the outer conduit 39 may be delivered through a fitting 53 and a hose 54 to the nozzle N as will later appear.

As best shown in FIG. 4 of the drawings it will be seen that the conduit 36 projects past the sealing member 52. In other words, the inner conduit extends beyond the lower end of conduit 39.

At 56 we show a split coupling which is employed to operatively connect the nozzle ends to the lower, extending end of the conduit 36. Thus, the coupling is adapted to fit about a grooved section 58 which is welded to the lower end 36$^b$ of the conduit 36.

Carried by a flange 59 secured to the coupling by bolts 61 is a first 45° elbow indicated at 61. On the lower end of elbow 61 is a swivel member 62. Fitting into the opposite end of the swivel member 62 is the upper end of a second 45° elbow conduit 63. Finally, the nozzle N is secured to the lower end of the second 45° elbow 63. It will be understood that the nozzle N is of the type to receive the dry, granular material flowing down the conduit 36 and that the same has a nozzle body 64 incorporaing a water ring, not shown. It will further be understood that water supplied through the conduit 54 is mixed in the nozzle body with the dry material so that the material exits the nozzle under pressure as wetted material. The details of the nozzle per se form no part of our invention inasmuch as this type nozzle heretofore has been used for various purposes such as gunniting and the application of wetted dry material such as we employ here. A suitable nozzle may be purchased from National Foundry Sand Co. 17321 Telegraph Road, Detroit, Mich. 48219.

Figure 10:
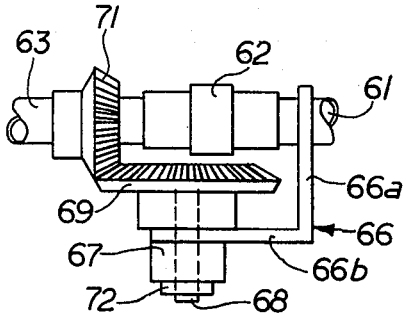
FIG. 10 is a fragmental plan view of the nozzle and associated mechanisms as viewed along line 10—10 of FIG. 9.
Figure 9:
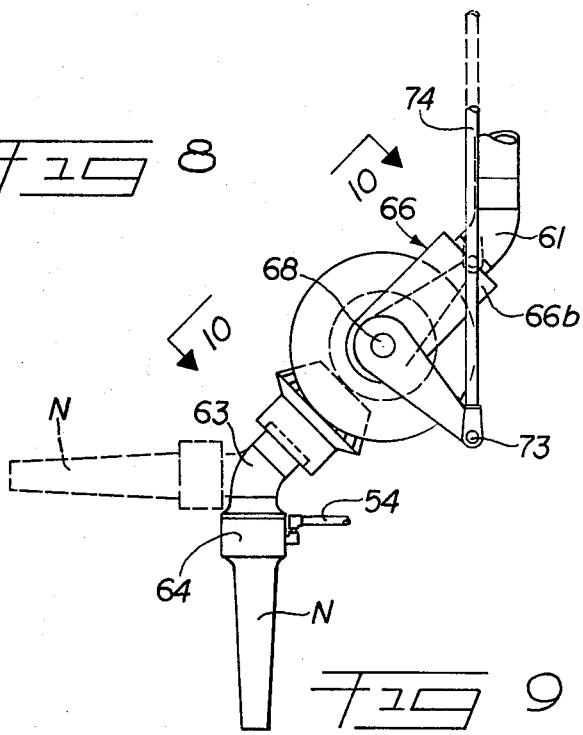
FIG. 9 is a fragmental side elevational view of the nozzle and operating means therefor as viewed along line 9—9 of FIG. 2.

As shown more particularly in FIGS. 9 and 10, a bracket member 66 has one of its legs 66$^a$ secured about the first of the 45° elbows. A second ninety degree leg 66$^b$ supports a bearing 67 through which passes a shaft 68. On the end of the shaft 68 nearest the swivel joint 62 we mount a bevel gear 69. Non-rotatably secured to the second of the 45° elbows is another bevel gear 71 in mesh with the gear 69. It will thus appear that whenever gear 69 is rotated gear 71 in turn will rotate.

Figure 11:
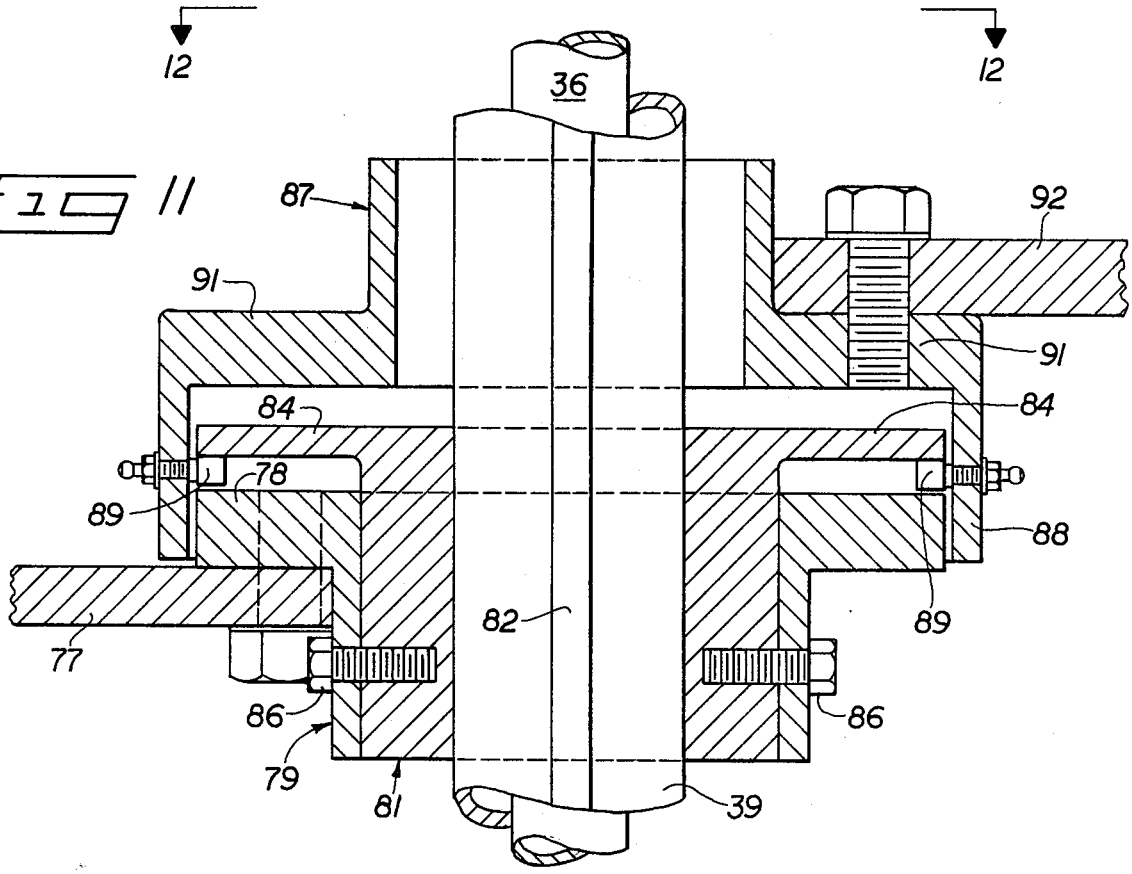
FIG. 11 is an enlarged detail sectional view of the mechanism for transmitting linear motion from a motorized means to the nozzle to angularly displace the nozzle; and, FIG. 12 is a detail sectional view taken generally along line 12—12 of FIG. 11.
Figure 12:
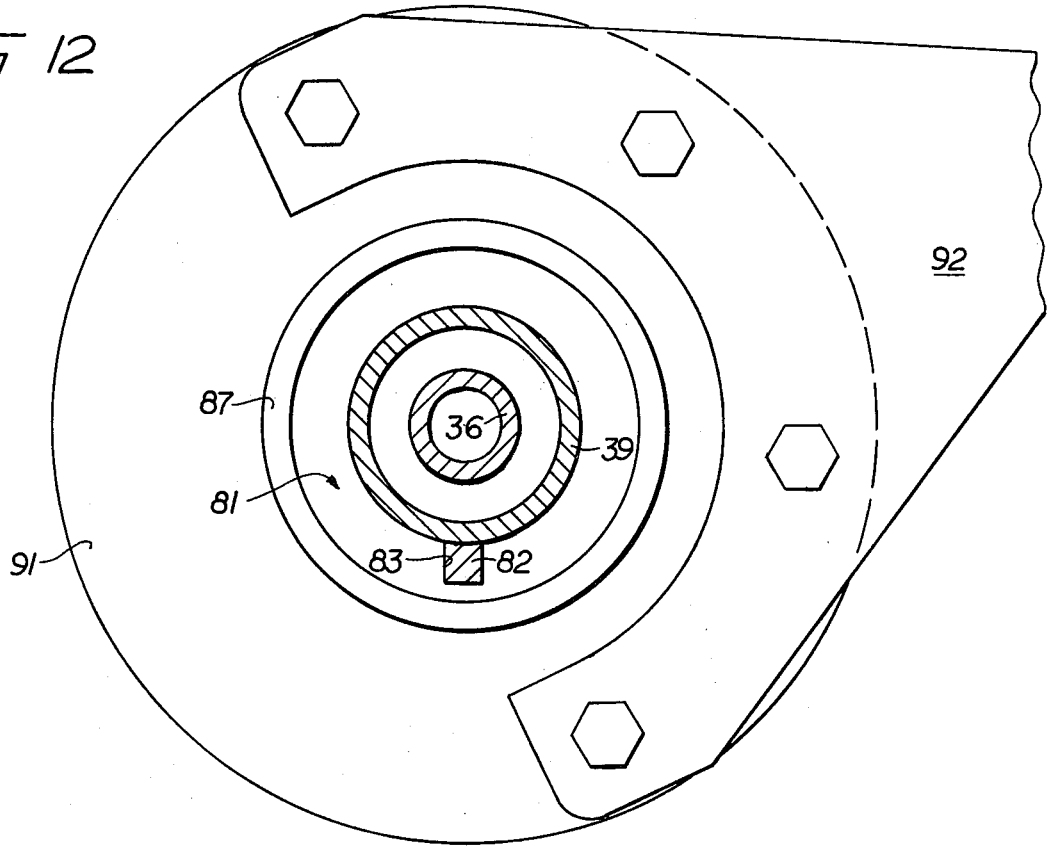

Secured to an extension of the shaft 68 is an arm 72. Pivotally connected at 73 to the outer end of the arm 72 is a push-pull link 74. The upper end of the link 74 is pivotally connected at 76 to a horizontally disposed arm 77. As shown more in detail in FIG. 11, the arm 77 is bolted to the horizontal flange 78 of a sleeve 79. The bore of the sleeve 79 surrounds a second sleeve 81, in turn bored to fit slidably but snugly about the outer surfaces of the conduit 39. As best shown in FIGS. 11 and 12 the conduit 39 is provided with an axially elongated spline member 82 and the sleeve 81 is provided with a keyway 83, slidably to receive the spline 82.

The sleeve 81 has a horizontally outstanding flange portion 84, spaced above the flange 78 of sleeve 79. Bolts 86 secure sleeves 79 and 81 non-rotatably together.

A third sleeve 87 has a depending annular skirt portion 88 which extends downwardly past the outer peripheries of the flanges 78 and 84. Projecting inwardly from the flange 88, to support the flange 84 and hence the sleeves 79 and 81 are bearing members 89.

From what has been so far described it will be seen that the sleeves 79 and 81 are non-rotatably but slidably secured to the outer conduit 39. The sleeve 87 is rotatably associated with the conduit 39 and the sleeves 79 and 81, but through the rollers 89 is connected therethrough for axial shifting movement.

Secured to a horizontal flange 91 of sleeve 87 is an upper arm 92. Connected to the arm 92 is a push-pull rod 93 and this rod is connected through a flexible coupling 94 to the reciprocating output rod 96 of a power driven unit 97. Preferably, the power driven unit 97 is what is called a "JACTUATOR". Specifically, such a unit may be purchased from the Duff-Norton Corporation, P. O. Box 1719, Charlotte, N. C. 28232. Also, the unit 97 preferably is powered by a reversible air motor 98, air being supplied to and from the motor 98 through lines 99. Suffice it here to say that when the motor 98 is energized the push-pull rod 93 moves axially up or down thereby sliding the entire collar assembly and arms 92 and 77 on the outer conduit member 39. At the same time both conduits 36 and 39, as well as arm 77, link 74 and the nozzle N are free to rotate substantially 360°. It will be understood that due to the roller arrangement between the sleeves 79 and 81, arm 92 and hence the push-pull rod 93 remain stationary in the sense of rotation.

Figure 2:
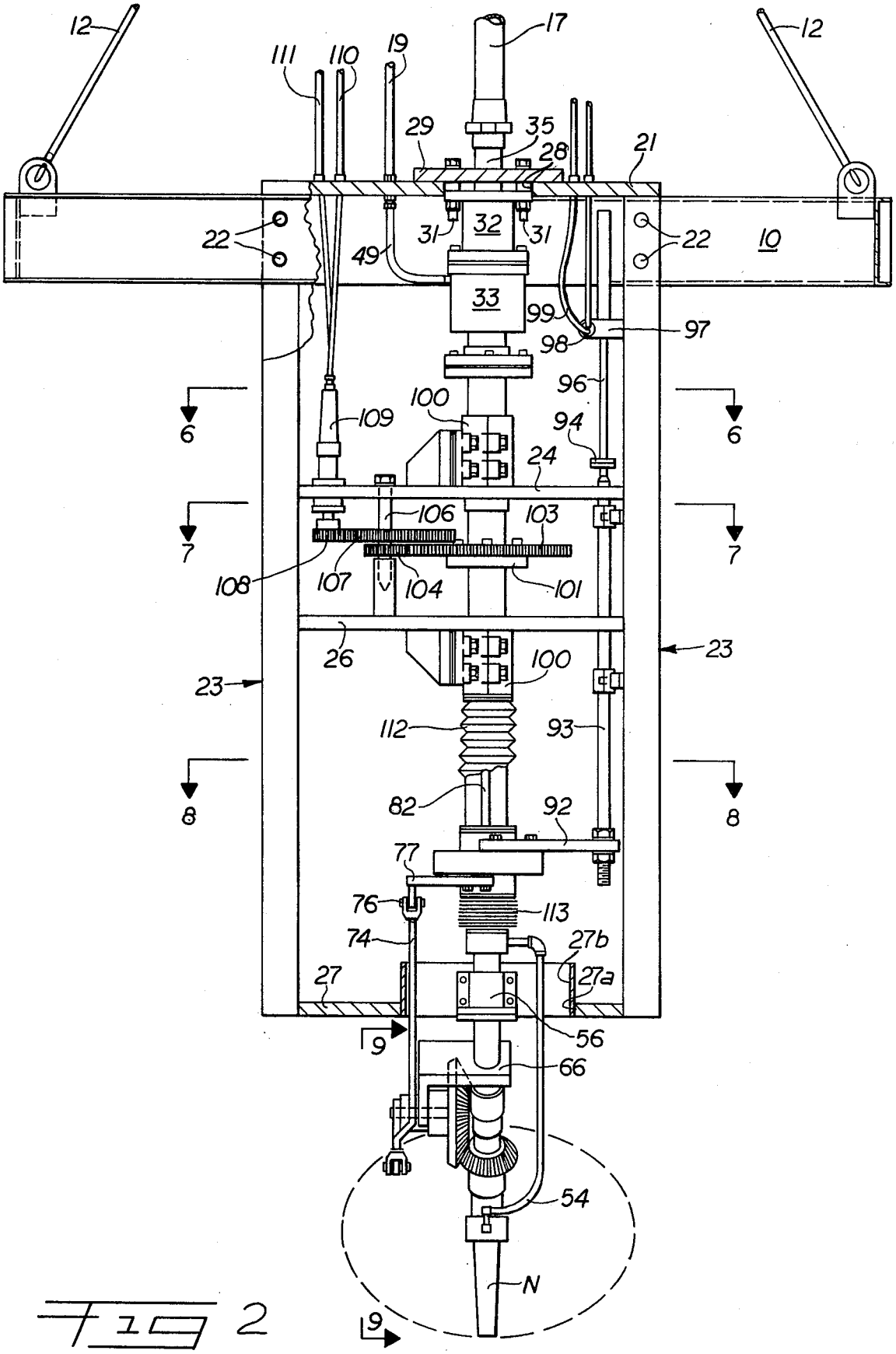
FIG. 2 is an enlarged fragmental detail view of our improved apparatus, certain parts being broken away and in section.

Referring particularly to FIGS. 2 and 3 of the drawings at 101 we show a flange welded to the outer conduit 39. Secured to the flange 101 by bolts 102 is a gear 103, preferably split for assembly purposes. In mesh with the gear 103 is a smaller gear 104 mounted on a jack shaft 106, suitably supported as shown, which in turn carries a third gear 107. Gear 107 is in mesh with a gear 108 which is driven from the output shaft of a reversible power driven means, preferably an air motor 109. Whenever air is supplied to the motor 109 through conduits 110 and 11, motor 109 rotates first in one direction and then in another. The outer conduit is rotatably supported in bearings 100 mounted on the plates 24 and 26. 111, In order to protect the sleeves and the spline connections we provide bellows type rubber covering boots 112 and 113.

From the description given so far it is now possible to explain more fully the construction, operation and advantages of our invention. It will be understood that our apparatus is suspended from a suitable crane through the cables 12 over the vessel whose lining is to be coated. It will further be understood that there are various valves and controls for the two motors 98 and 109 which may be remotely controlled by an operator through flexible hoses, not shown, attached to our apparatus.

With the apparatus suspended in position the dry material and water are supplied as before indicated. The operator with the control valves are suitably located at a position generally above and comfortably removed from the vessel whose lining is to be coated, visually observes the place where the output from the nozzle N strikes the lining 11[a]. By suitable manipulation of the motor 98 and he can raise and lower the nozzle N from the full line position shown in FIG. 9 to the dotted line position shown therein, or, substantially through ninety degrees. The mounting of the nozzle as disclosed permits it to be moved from a position substantially parallel with the axes of conduits 36 and 39 to a position angularly displaced from said axes. Further, by operation of the motor 109 the entire outer conduit 39, and hence the nozzle as well as the conduit 54, link 74, arm 77, etc., can be rotated substantially 360°. With these two motions independently at his control, the operator is above to coat, selectively, if desired, any portion of the lining. Furthermore, the operator is able to stop the mechanism in any position desired to apply the material to any desired localized area of the lining. When necessary the entire device is raised through the crane which suspends it, whereby the entire lining may be coated.

Our invention is characterized by the fact that we have eliminated, from the area of the nozzle itself, all rotary seals except the one carrying the dry material. That is to say, water is supplied from the lower end of the outer conduit, directly to the nozzle end through the pipe 54. This therefore eliminates the requirement of seals at the place where they would most likely be damaged, namely, near the nozzle, which, when treating hot vessels is subject to the greatest heat damage.

In actual practice our invention has proven to be extremely satisfactory. With our apparatus we are able to coat ladles and the like while still hot, thus eliminating the requirement of cooling them and reheating. Our invention thus is characterized by the fact that through its use we conserve considerable energy and at the same time are able to repair the linings of ladles and the like thus to prolong their lives.

While we have shown our invention in but one form, it will be obvious to those skilled in the art that it is not so limited, but susceptible of various changes and modifications without departing from the spirit thereof.

What we claim is:

1. In apparatus for applying granular refractory material to the interior surfaces of an open top ladle, furnace, or the like, (a) a pair of generally vertically disposed telescopically related conduits, (b) means to supply granular refractory material to the upper end of the inner one of said conduits, (c) means to supply water to the upper end of the outer one of said conduits, (d) means to support said conduits for substantially 360° simultaneous rotation, (e) said inner conduit having a lower end portion projecting past the lower end of the outer conduit, (f) a mixing nozzle on the lower end of the inner conduit in position to receive and discharge granular material flowing down the inner conduit, (g) means to supply water from the lower end of the outer conduit to said nozzle, (h) means mounting said nozzle for angular displacement relative to the longitudinal axis of said conduits, and (i) power means operatively connected to the nozzle for displacing the same relative to the longitudinal axis of said conduits.

2. Apparatus as defined in claim 1 in which there is power means operatively connected to said conduits for rotating them substantially 360°.

3. Apparatus as defined in claim 1 in which the operative connection of said power means to said nozzle comprises a sleeve slidably and non-rotatably mounted about the outer conduit, another sleeve slidably and rotatably mounted about the conduit, means rotatably but non-slidably connecting the said sleeves, means operatively connecting the first named sleeve to the nozzle, and means operatively connecting the last named sleeve to said power means, whereby the displacement of the nozzle may be accomplished by sliding said sleeves axially on the outer conduit while permitting rotation of said conduits and said nozzle.

4. Apparatus as defined in claim 3 in which the nozzle is non-rotatably mounted relative to the lower end of the inner conduit, said means to angularly displace the nozzle relative to the longitudinal axis of said conduits comprising a gear mounted for rotation adjacent the lower end of the inner conduit, a second gear carried by the nozzle, a rotary joint in the inner conduit adjacent said gears, and a link connection between said first named gear and said last named sleeve, whereby sliding said sleeves relative to the outer conduit rotates said first named gear.

5. Apparatus as defined in claim 1 in which the means to support said conduits for substantially 360° rotation comprises a connecting member having an upper portion to which the upper end of the inner conduit is rotatably connected in substantially fluid-tight manner, a lower section to which the upper end of the outer conduit is rotatably connected in substantially fluid-tight manner, means to supply granular material through the upper section of said member into the upper end of the inner conduit, and means to supply water to the upper end of the outer conduit through the lower section of said member.

6. Apparatus as defined in claim 1 in which the nozzle is mounted in offset relation to the longitudinal axes of said conduits and is movable from substantially vertical position to substantially horizontal positions on either side of said vertical position.

* * * * *